US005784864A

United States Patent [19]

Laury

[11] Patent Number: 5,784,864

[45] Date of Patent: Jul. 28, 1998

[54] MACHINE FOR OVERWRAPPING BAGGAGE

[75] Inventor: Daniel Laury, Neuilly, France

[73] Assignee: Probag S.A., Paris, France

[21] Appl. No.: 737,289

[22] PCT Filed: May 9, 1995

[86] PCT No.: PCT/FR95/00598

§ 371 Date: Nov. 8, 1996

§ 102(e) Date: Nov. 8, 1996

[87] PCT Pub. No.: WO95/30580

PCT Pub. Date: Nov. 16, 1995

[30] Foreign Application Priority Data

May 9, 1994 [FR] France ..... 94 05687

[51] Int. Cl.[6] ..... B65B 53/02; B65B 57/00

[52] U.S. Cl. ..... 53/557; 53/54

[58] Field of Search ..... 53/557, 442, 53, 53/54

[56] References Cited

U.S. PATENT DOCUMENTS

| | | | |
|---|---|---|---|
| 3,605,283 | 9/1971 | Zelnick et al. | 53/557 X |
| 4,984,409 | 1/1991 | Focke | 53/53 |

FOREIGN PATENT DOCUMENTS

| | | | |
|---|---|---|---|
| 0 011 338 | 5/1980 | European Pat. Off. . | |
| 2 696 709 | 4/1994 | France . | |
| 6144414 | 5/1994 | Japan | 53/54 |
| WO 92/13765 | 8/1992 | WIPO . | |

*Primary Examiner*—Linda Johnson
*Attorney, Agent, or Firm*—Young & Thompson

[57] ABSTRACT

Machine for overwrapping baggage (4) suitable for any mode of transport, in particular air travel, and successively comprising, upstream to downstream, a baggage arrival station (1) having an upstream entry conveyor (6) on which the baggage (4) to be wrapped is placed flat and a station (2) for forming a protective tubular enclosure of shrinkable thermo-plastic material over each baggage. The machine comprises an intermediate conveyor (7) for the enclosing operation and a shrinking tunnel oven (3) through which a downstream conveyor (8) extends, the endless conveyors (6, 7, 8) extending horizontally and being aligned and driven in the same direction, to enable the baggage to be fully wrapped at the outlet of the oven (3) after shrinkage of the plastic material. The machine is characterized in that a security control apparatus (19, 21) is placed in the baggage arrival station so that the inside of each baggage (4) which is placed flat on the upstream endless conveyor (6) is visually controlled before the tubular protective enclosure is applied.

3 Claims, 1 Drawing Sheet

MACHINE FOR OVERWRAPPING BAGGAGE

FIELD OF THE INVENTION

The present invention relates to a machine for overwrapping baggage of users of various means of transport and in particular of air-transport passengers.

BACKGROUND OF THE INVENTION

Baggage, such as rigid or supple suitcases, bags, golf bags, pairs of skis, etc . . . of passengers using means of transport and in particular air transport, often undergoes damage during transport, resulting from bumps, friction or bad weather. Furthermore, even if it is provided with "safety" locks, it may be forced during handling and the owners of baggage can but ascertain the theft that they have suffered when recovering their baggage. Finally, the baggage may be opened for terrorist purposes, for installing an explosive device therein.

To overcome these drawbacks, automatic overwrapping machines have already been envisaged, comprising an upstream packing section in which each piece of baggage displaced on a conveyor belt is enveloped in a film of heat-shrinkable plastics material, and a downstream section comprising an oven for heat-shrinking, through which each piece of baggage, provided with its heat-shrinkable envelope, passes. The baggage leaves at the exit of the heat-shrinking oven, protected by an envelope of shrunk plastics material. Such overwrapping machines are described for example in U.S. Pat. No. 3,815,313, WO 87/00144 and FR-A-2 680 154.

Patent FR-A-2 696 709 also discloses an installation and a process for rendering collective baggage transport safe. This installation comprises a baggage-transporting conveyor disposed so that the baggage is transported entirely in a zone inaccessible to unauthorized persons. Such an installation further comprises means for monitoring the presence of metal objects as well as a station for sealing the monitored baggage by means of a heat-shrinkable film. It is here question of an installation comprising a plurality of work stations possibly disposed in different rooms, such an installation not making it possible to eject baggage which has been detected as suspect.

The present invention relates to improvements in these types of overwrapping machines so as to enable them to make both a safety check and an automatic evacuation of suspect baggage.

SUMMARY OF THE INVENTION

The present invention thus has for its object a machine for overwrapping baggage of users of any mode of transport and in particular air transport, successively comprising, upstream to downstream, a baggage arrival station comprising an upstream entry conveyor on which the baggage to be wrapped is placed flat, and a security control apparatus disposed so as to make a visual check of the interior of each piece of baggage placed flat on the upstream conveyor, a station for forming a protective tubular enclosure, made of shrinkable thermoplastics material, around each piece of baggage, comprising an intermediate enclosing conveyor, and a tunnel oven for shrinking, through which a downstream conveyor extends, the endless conveyors extending horizontally and being aligned and driven in the same direction, so as to obtain at the exit of the oven, further to the shrinking of the plastics material, fully overwrapped baggage, characterized in that it comprises a common housing isolating from the outside all the elements constituting the overwrapping machine and the security control apparatus and ejection means which make it possible, when a piece of baggage is indicated by the security control apparatus as being suspect, to stop advance of said baggage within the enclosure and to eject it immediately after detection and before the baggage is admitted in the station forming the protective enclosure.

BRIEF DESCRIPTION OF THE DRAWINGS

A form of embodiment of the present invention will be described hereinafter by way of non-limiting example, with reference to the accompanying drawings, in which.

Figure 1:
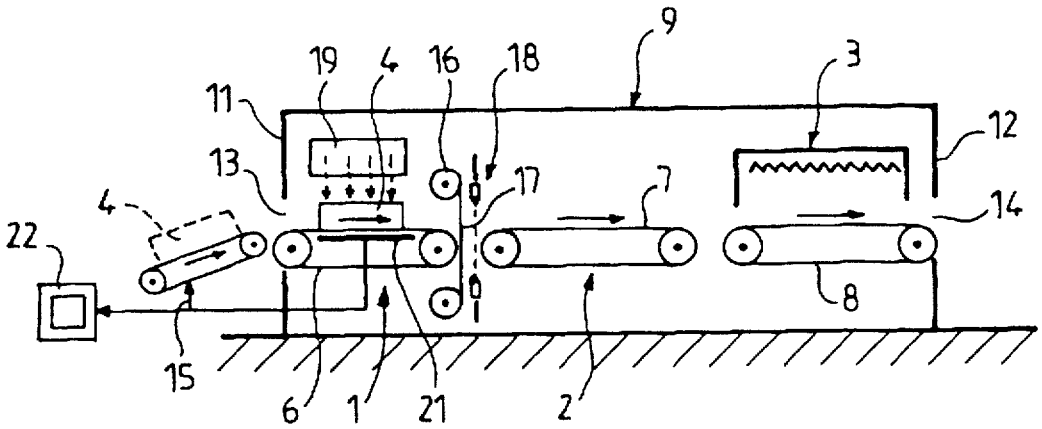
FIGS. 1 and 2 are schematic views in vertical and longitudinal section of a machine for automatically overwrapping passenger baggage according to the invention, respectively during various stages of its operation.
Figure 2:
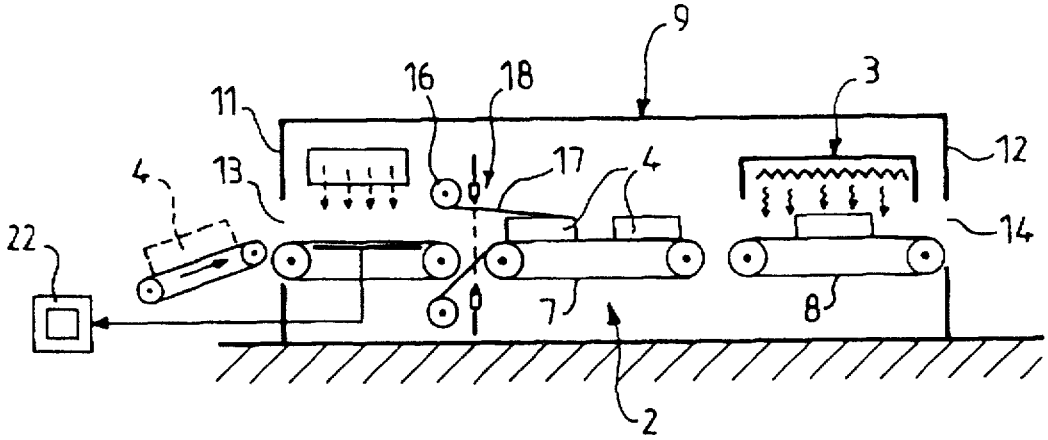

The automatic machine according to the invention, which is schematically shown in FIGS. 1 and 2, is intended to form an enclosure around passenger baggage, for protection against damage that may be caused to each piece of baggage itself during transport, against theft of the objects contained in the baggage and against untimely opening of the baggage for any other reason during handling.

The machine according to the invention offers the advantage that it also makes it possible to effect a radioscopy of each piece of baggage before it is surrounded by its protective enclosure. As the radioscopy apparatus can easily be housed in the upstream baggage arrival station, the ground space requirement is limited to the length of the wrapping machine. Furthermore, the structure of the radioscopy apparatus may be simplified, hence a reduction in the overall cost of the whole, insofar as the function or screen with respect to the environment may be performed by the wall of the enclosure of the machine.

The machine according to the invention successively comprises, upstream to downstream, a baggage arrival station 1, a station 2 for forming a protective tubular enclosure, made of shrinkable thermoplastics material, around each piece of baggage, and a tunnel oven 3 for shrinking, possibly followed by a cooling device (not shown). The baggage 4 which is to be overwrapped and which is constituted by suitcases, bags, etc . . ., is displaced through successive stations 1 to 3 of the machine by means of a plurality of horizontal, aligned, endless conveyors driven in the same direction, i.e. from left to right in FIGS. 1 and 2, namely an upstream inlet conveyor 6, an intermediate enclosing conveyor 7 and a downstream conveyor 8 extending through the shrinking oven 3.

Successive stations 1 to 3 of the machine are advantageously housed within a common enclosure 9 comprising two vertical front walls, upstream 11 and downstream 12, in which are respectively formed inlet (13) and outlet (14) openings. These openings are placed opposite the upstream (6) and downstream (8) conveyors and they are dimensioned so as to allow baggage 4 placed flat on the conveyors to enter and exit.

The upstream conveyor 6 may extend horizontally outside the enclosure 9, through the opening 11, to enable the baggage 4 to be deposited directly thereon. In the form of embodiment shown in FIGS. 1 and 2, an additional conveyor 15 for introducing the baggage 4 into the enclosure 9 is provided, which is inclined upwardly in the direction of movement of the baggage and which terminates in the immediate vicinity of the upstream end of the upstream conveyor 6. In known manner, the successive pieces of baggage 4 which are introduced in the enclosure 9, on the upstream conveyor 6, then pass through the enclosing station 2 comprising the intermediate conveyor 7. This enclosing station may per se be of any known type, for example the one used in packing machines used in particular for distributing food products. Station 2 will therefore not be described in detail and it suffices to indicate that this station comprises a device 16 for forming, in the gap between the two conveyors 6 and 7, a vertical, transverse curtain constituted by at least one sheet 17 of heat-shrinkable plastics material. In the non-limiting form of embodiment shown in FIGS. 1 and 2, the sheet 17 is in fact formed by two sheets welded together transversely and unwound respectively from two upper and lower rollers of horizontal and transverse axes. The two parts constituting the sheet 17 are welded to each other by the passage of the preceding baggage, being encountered by each baggage 4 and driven downstream thereby, as shown in FIG. 2. A transverse welding device 18, comprising two horizontal and transverse jaws, of which at least one is vertically mobile in reciprocating manner, is provided a little downstream of the device 16 supplying the sheet 17, in order to effect, after each piece of baggage has been enveloped, a transverse welded seal of the two parts of the sheet 17, in the vicinity of each transverse face of the baggage 4. Consequently, each piece of baggage 4 is provided with a tubular enclosure which is obtained by winding the sheet 17 around the baggage 4.

The baggage 4 thus provided with its tubular enclosure then passes over the downstream conveyor belt 8 and it is driven thereby through the shrinking tunnel oven 3. The tubular enclosure formed by the sheet 17 then shrinks on all sides over the baggage 4, and the enclosed baggage 4 can then be evacuated, thus being protected, for its continued conveyance.

According to the invention, the baggage overwrapping machine also makes it possible to effect a security control of said baggage in the baggage arrival station 1. To that end, the baggage arrival station 1 is equipped with a safety control apparatus such as a radioscopy apparatus of any known type, particularly X-ray, comprising a source of X-rays 19, located above (or below) the upper side of the upstream conveyor 6, a detector 21 located below (or above) the upper side of the upstream conveyor 6 and an apparatus with monitoring screen 22 located at a distance and connected to the detector 21.

In this form of embodiment, the enclosure 9 is designed so as to isolate the radioscopy apparatus 19, 21 from the outside, and the opening 13 for the entrance of the baggage is advantageously obturated by a flexible curtain allowing the baggage to enter the enclosure 9, on the upstream conveyor 6.

The machine according to the invention offers the advantage that the operations of security control and overwrapping of the baggage are carried out continuously, one after the other, within the same enclosure, given every guarantee of protection.

In an embodiment of the invention, the machine may comprise means for ensuring ejection of a piece of baggage indicated by the detection means as being suspect. Of course, such ejection will be effected immediately after detection and before the baggage is admitted to the station 2 forming the protective enclosure.

Ejection may be effected by any means, automatic or not, and in particular by means reversing the direction of displacement of the conveyors 6 and 15.

I claim:

1. Apparatus for overwrapping baggage, comprising in succession, upstream to downstream:

a baggage arrival station including an upstream conveyor for placing flat thereon baggage to be wrapped, and security control means operatively disposed for visually inspecting the contents of each piece of baggage placed flat on the upstream conveyor;

a station for forming a protective tubular enclosure, made of shrinkable thermoplastic material, around each piece of baggage, comprising an intermediate enclosing conveyor;

a third station including a downstream conveyor, and a tunnel oven for heat shrinking the protective tubular enclosure;

said conveyors extending in a horizontal direction and being aligned, and means for driving said conveyors in the same direction so as to obtain after the third station overwrapped baggage;

a common enclosure for housing said stations; and ejection means for ejecting a piece of baggage indicated by the security control means as being suspect, said ejection means being constructed and arranged to stop advance of said baggage within the common enclosure and eject said baggage immediately after detection, and before said baggage reaches the station for forming the protective enclosure.

2. Apparatus according to claim 1, wherein the ejection means include reverser means which manually or automatically reverse the direction of displacement of at least the upstream conveyor.

3. Apparatus according to claim 1, wherein the common enclosure comprises an upstream front wall having an opening operated by a flexible curtain for admitting baggage onto the upstream conveyor, and said security control means are positioned behind said front wall.

* * * * *